US005933009A

United States Patent [19]

Kayser

[11] Patent Number: 5,933,009

[45] Date of Patent: Aug. 3, 1999

[54] SPARK PLUG IGNITED ENGINE ANALYZING DEVICE AND METHOD

[76] Inventor: William M. Kayser, 6408 81st Ave. North, Brooklyn Park, Minn. 55445

[21] Appl. No.: 08/610,885

[22] Filed: May 30, 1996

Related U.S. Application Data

[63] Continuation-in-part of application No. 08/338,665, Nov. 19, 1994, abandoned.

[51] Int. Cl.[6] ..... F02P 17/12

[52] U.S. Cl. ..... 324/399; 324/379; 324/393; 73/117.3

[58] Field of Search ..... 324/378, 379, 324/393, 399, 503; 73/117.3; 123/644

[56] References Cited

U.S. PATENT DOCUMENTS 4,558,280 12/1985 Koehl et al. ..... 324/399
5,387,870 2/1995 Knapp et al. ..... 324/379

*Primary Examiner*—Glenn W. Brown
*Attorney, Agent, or Firm*—Robert A. Pajak

[57] ABSTRACT

An engine analyzing device for an internal combustion engine including a spark generator and means for testing the voltage of the sparks generated for a diagnosis of engine performance, the testing of the sparks generated relating to analysis of the spark voltage wave form from the breakdown voltage, the collapsing field voltage and the duration of the spark pulse or some combination of these.

19 Claims, 7 Drawing Sheets

SPARK PLUG IGNITED ENGINE ANALYZING DEVICE AND METHOD

This application is a continuation-in-part of U.S. Pat. application Ser. No. 08/338,665 filed Nov. 19, 1994, now abandoned.

BACKGROUND OF THE INVENTION

1. Field of Invention

This invention relates to the field of engine analyzing devices for spark plug ignited combustion engines.

2. Description of the Previous Art

The purpose here is to analyze an engine's operation by an analysis of the voltage produced by a spark plug.

In ordinary operation, the magnitude of a spark plug's voltage is determined by the spark plug itself and not by the ignition system. The spark plug determines the spark size by its gap size and by the material within the gap. The gap of a spark plug changes only slightly with the miles of operation of a motor vehicle engine. Voltage, however, changes rapidly from one burn cycle to the next. These changes are due possibly to the material changes within the gap of the spark plug from one burn cycle to the next.

As a cylinder in an engine burns its fuel, it produces ionized gases and the more gases there are in the spark plug gap from burning, the lower the electrical resistance across that gap will be. This lower resistance will reduce the magnitude of the voltages across the spark plug gap.

Current engine analysis devices may have the ability to display a particular characteristic of a spark voltage that is processed by the apparatus of this invention. Those devices may also function to determine an average value for that characteristic. However, no current engine analysis devices can process a voltage to produce an output that is an instantaneous running average of the characteristic. Further the device herein provides information about the burning process inside an engine that no other device is known to provide.

Reference is had to U.S. Pat. No. 5,387,870, to Knapp, which covers an analysis of spark waveform of the breakdown voltage, but does not see the entire waveform and this is critical. Knapp's disclosure only works in real time because he samples, whereas the invention reads the waveform continuously. The invention herein also differs in that Knapp does not utilize collapsing field voltage, whereas the invention herein utilizes the entire waveform, including the collapsing field voltage which indicates engine combustion performance.

SUMMARY OF THE INVENTION

This invention relates to an analyzing device for a spark plug ignited internal combustion engine. A means for sensing generated sparks is coupled to a spark plug to transmit spark signals proportional to each of the generated sparks. Each sensing means is connected to a circuit of the analyzing device which is capable of analyzing the spark and of producing an output that will enable either the user or an attached computing device to evaluate the function of the engine based on the analysis of one or more of sensed spark voltages.

The apparatus of this invention is particularly adapted for processing the voltage produced in the gap of a spark plug in order to identify all of the problems in the operation of an internal combustion engine.

A particular disclosing and reliable feature of the invention herein is that its analysis of spark plug voltage is that it produces an instantaneous and continuous running average reading of one or more features of the voltage in the gap of a spark plug.

A unique aspect of the engine performance analysis of the device comprising the invention herein is that the analysis gathers information from a number of spark plug firings which is used to calculate readings from which qualities of a spark wave can be analyzed. This calculation may be derived from either the breakdown voltage, the collapsing field voltage or from the spark voltage pulse duration or from a combination of two or more of these. This is contrasted to the prior art which only displays spark voltages generally.

The calculation derived from a number of spark plug firings may be referred to as an averaged reading or voltage value. This averaged reading is important in providing significant information about the operation of an engine which any single reading of a spark plug firing would not supply. The reason why one reading does not supply sufficiently useful information is the great disparity in such readings from one spark plug firing to the next in engines that are operating properly. The averaged reading obtained evens out the typical variations of the engine and creates an output which reflects the actual ongoing operation of an engine.

The engine analysis device in processing the voltage of spark plug firings discloses features which relate to the proper operation of an engine and particularly invaluable is the fact that the analysis of the engine's operation is observed during the time that incidents interfering with the proper operation of the engine are actually occurring.

Further, the present invention can determine the effectiveness of the voltage of sparks that have been delivered to an engine. If an engine is not burning fuel properly, the invention will point out any and all cylinders not functioning properly and also a variety of engine problems such as clogged fuel injectors, bad exhaust systems, bad valves, incorrect timing and other problems which may cause poor combustion, improper cylinder operation and other problems. Thus, with the invention herein, the spark plug acts as if it were a sensing probe within the engine.

The present invention further uniquely picks up the electromagnetic energy radiated by the electrons flowing in spark plug wires. Prior art devices either capacitively, inductively, or directly couple the electronic signals in spark plug wires.

Prior art devices require a common ground with the engine being tested. The invention herein, on the other hand, does not require a common ground with the engine being tested.

The main advantage of the invention's unique independent grounding is that it is able to detect a signal that prior art devices reject and consider to be undesirable electrical noise. Electrons flowing to and from the spark plugs generate an electromagnetic energy that is picked up by the engine's electronic circuitry and is normally called electrical noise. This noise elimination is accomplished by making the noise voltage common to the ground voltage of the engine's electronic circuitry. This electrical noise in the engine's circuitry is invisible to prior art devices because prior art device's ground voltages are electrically connected to the engine's ground voltages. Because the invention's ground is independent of the engine's ground voltage it is able to detect spark plug signals in the engine's circuitry that no prior art devices are capable of detecting.

DESCRIPTION OF A PREFERRED EMBODIMENT

Figure 3:
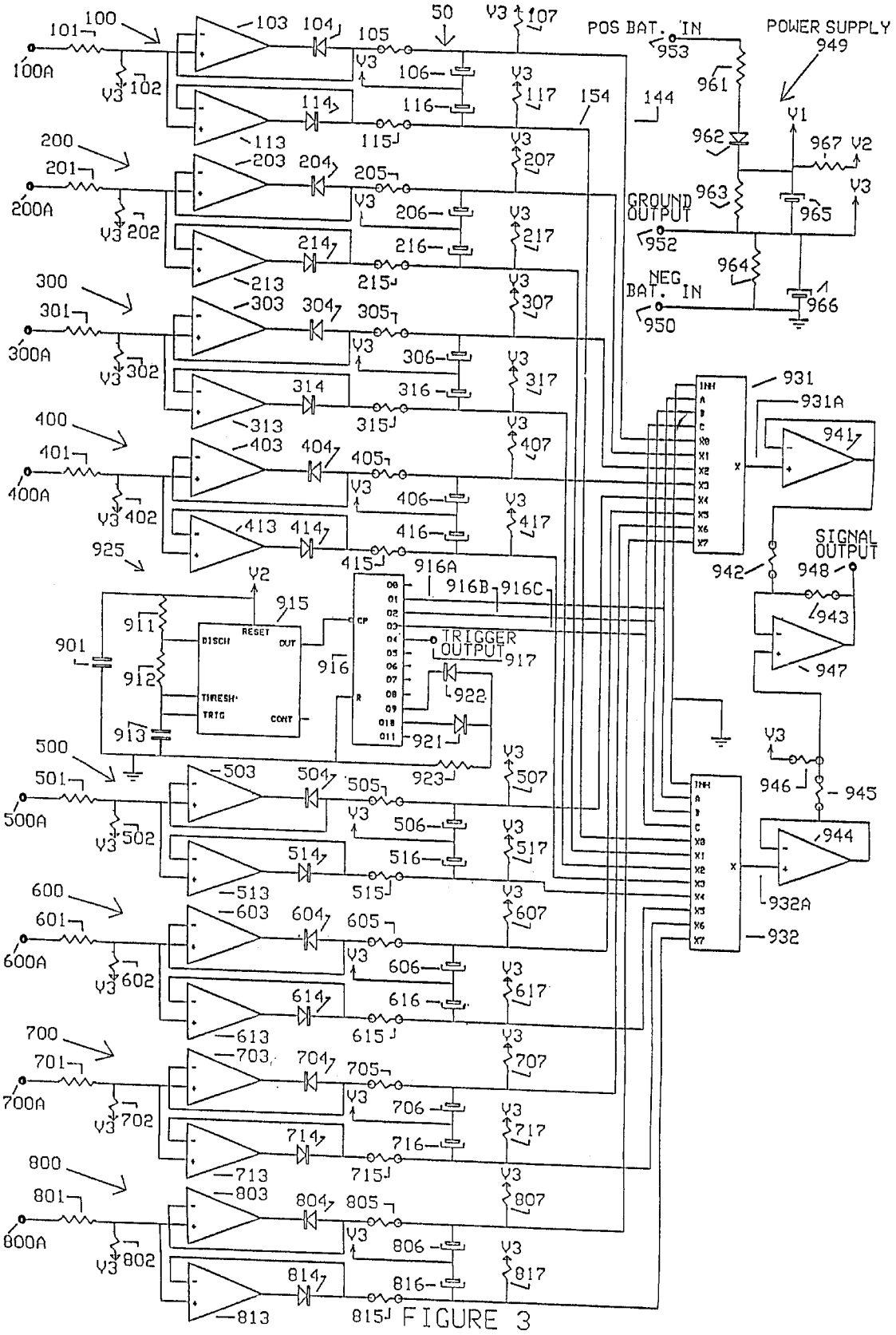
FIG. 3 is a schematic diagram of the circuitry of the invention herein.

A preferred embodiment of the circuitry of the device comprising the invention herein is shown is FIG. 3 and is indicated generally by the reference numeral 50.

Figure 7:
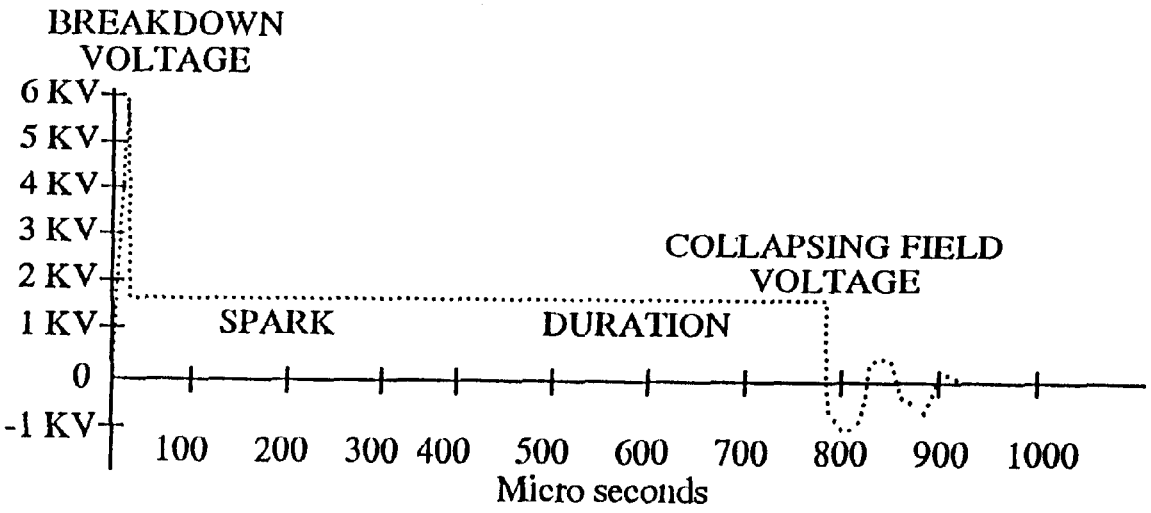
FIG. 7 is a diagrammatic view of a spark plug waveform.

A unique aspect of engine analysis from spark plug firings is the information derived from the breakdown voltage, collapsing field voltage or the voltage pulse duration thereof or a combination thereof and FIG. 7 provides a diagrammatic illustration of the voltage waveforms.

Figure 1:
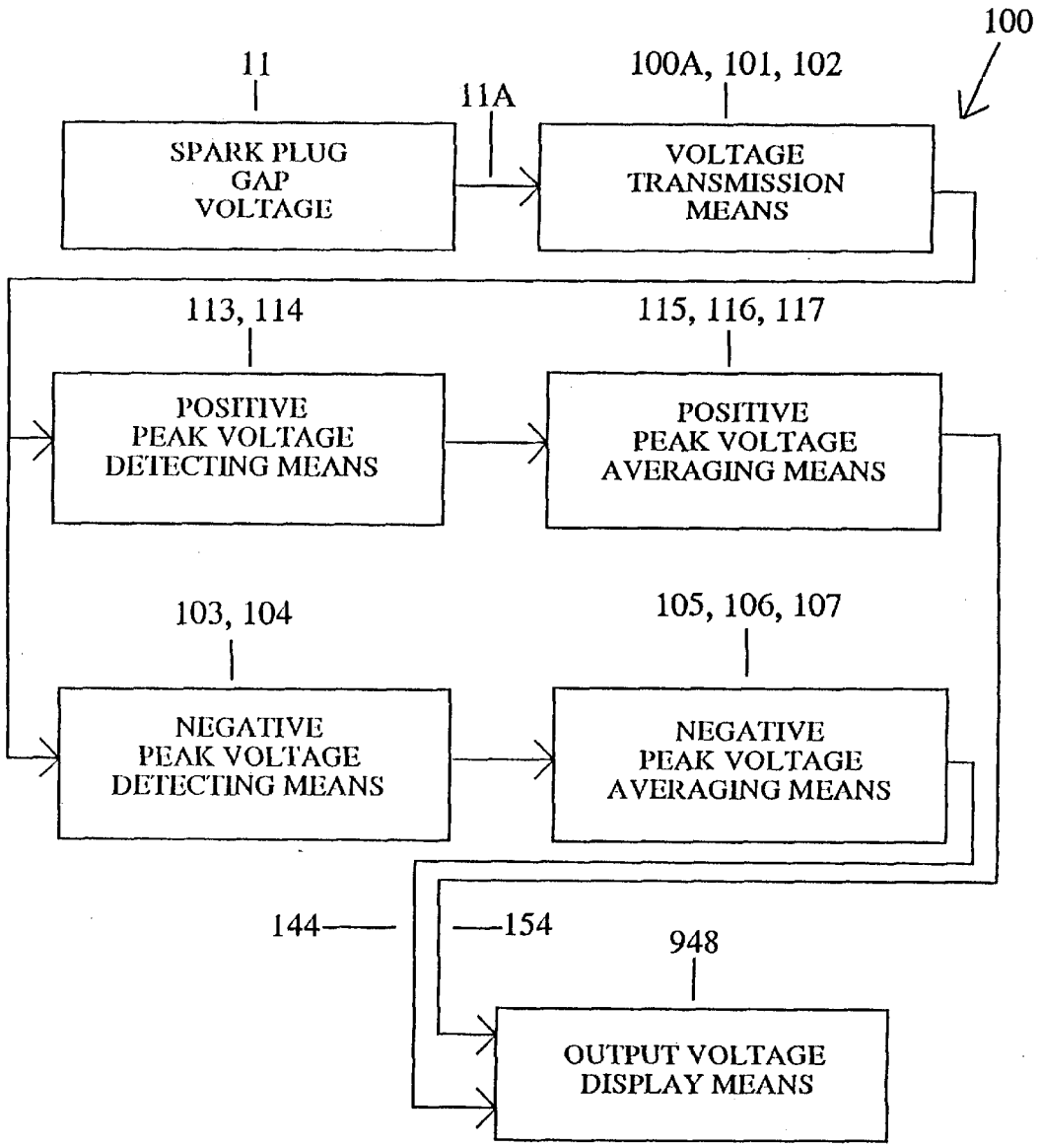
FIG. 1 is a flow chart of the basic operation of steps of the invention herein.

Going now to FIG. 1, a flow diagram of the operating function of the invention herein is shown wherein a spark plug gap voltage 11 is conducted by a line 11*a* to the device comprising the invention herein for transmission means 100*a*, 101 and 102 which reduce the voltage received to a value for signal processing through the device, then to detection of peaks of said voltage by means 113, 114 and 103, 104 and securing averaged peak voltage readings by means of the elements 115, 116, 117 and 105, 106 and 107, the same being arranged for display through the output element 948. It is noted that the voltage of a spark plug is in the thousands of volts, whereas the device herein in operation requires only a few volts.

A detailed description will now be given particularly in connection with FIGS. 2 and 3.

First, with general reference to the above, a spark plug signal or voltage change may be sensed even in the absence of significant current changes by a conventional conductive means such as a clamp, not here shown, with such means engaging the insulation about a spark plug wire, said wire and means in effect forming the plates of a capacitor and said insulation forming a dielectric therebetween. This, in prior art, where a common ground is used, provides capacitive coupling. In connection with the invention however, having an independent ground, said wire is an electromagnetic source and said means forms a closely coupled antenna.

Referring to FIG. 3, the voltage transmission means in the present embodiment is shown as including an incoming or input line 100*a* of FIG. 3, which includes a very simple voltage divider comprising a pair of resistors such as 101 and 102. Resistor 101 feeds into and through the resistor 102, the resistors having a ratio on the order of 1000 to 1, which reduces the voltage accordingly to a useable value. This is all well known in the art and may be variously otherwise accomplished.

The voltage thus having been reduced is fed into the processing of the circuitry of the device of the invention as shown and as described in connection with FIGS. 2 and 3.

FIG. 3, in showing a preferred embodiment of the circuitry of the invention herein shows it adapted to analyze the voltage of an eight cylinder engine. The analysis being the same for each cylinder, the circuitry is described for one cylinder as in the enlarged showing of the circuitry 100 of FIG. 2 and the remaining circuits 200–800 are analyzed identically in sequence for the remaining cylinders, the same having applied thereto sequential numbers for reference as if the same were specifically described herein.

The specific elements comprising the invention and the specific elements of the circuitry and the connection thereof are not individually described as all are well known in the art. It is their unique combination which comprises the invention. The circuitry in accordance with the present invention does not require a common electrical connection with the circuitry of the engine ignition system.

Figure 2:
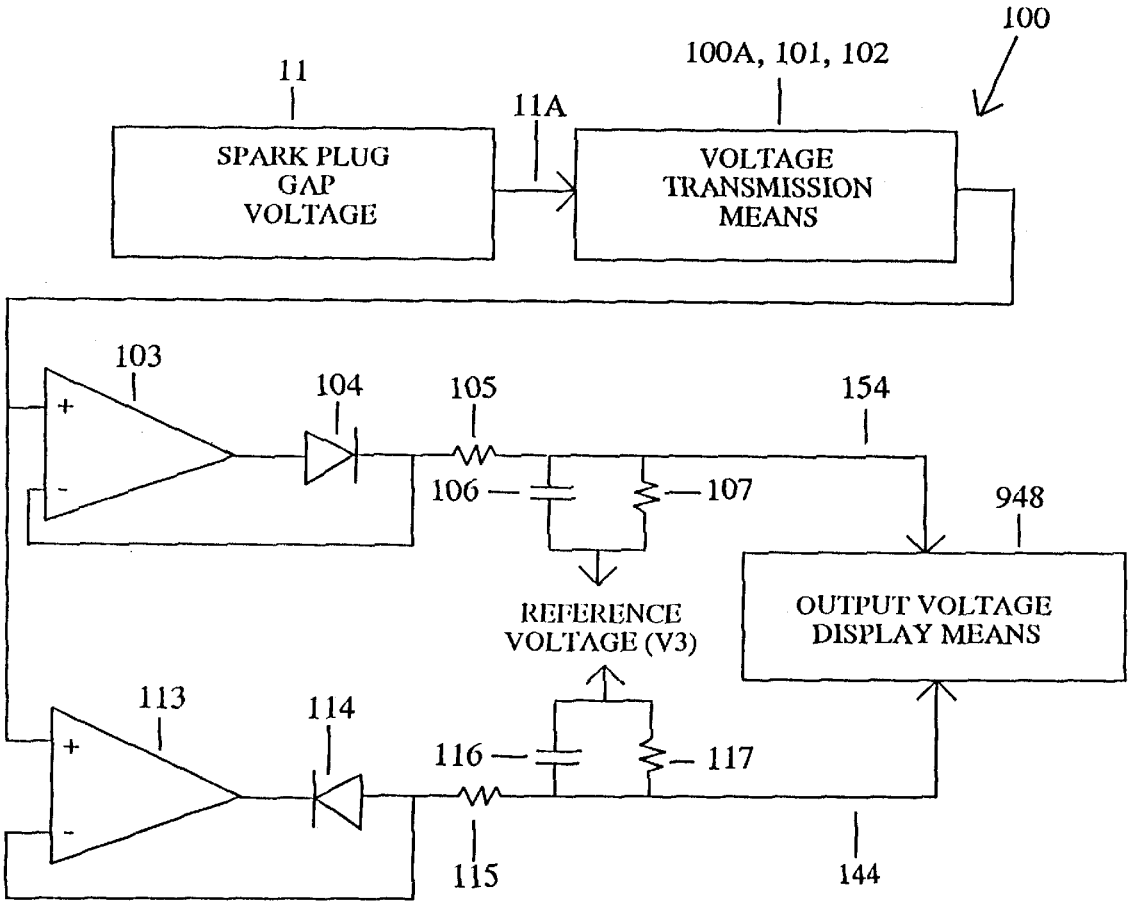
FIG. 2 is a partial flow chart combined with an enlarged schematic showing of a circuit.

The reduced voltage or electrical signal, referring to FIG. 2, from the voltage transmission means 100*a*, 101 and 102 is conducted by the conventional wiring to circuitry 100 of the first cylinder comprising circuit elements 103 and 113 which are operational amplifiers which are connected to diodes 104 and 114 which respectively detect peak negative and peak positive voltages while allowing said reduced voltage to pass through in one direction only. These circuit elements are referred to as peak voltage detectors because capacitors 106 and 116 to which said voltage passes will be charging while the device herein is in operation and only voltage with magnitude greater than that of the respective associated capacitor will pass through. Hence, only the highest peaks of said reduced voltage will pass through.

Said capacitors 106 and 116 function as analog computers and perform this function either through their charging or discharging activity.

Resistors 105 and 115 control the charging of said capacitors while resistors 107 and 117, as shown, control the discharging thereof. This limitation on the charging results in a number of spark plug firings being required to charge the capacitors rather than just one firing. Thus, as an end result, there is determined a running average or an averaged spark plug voltage reading which has occurred during the previous period, possibly being a five second period of engine operation.

For a description up to the output of the voltage display means of FIG. 1, reference is now had to FIG. 3

Conductors 144 and 154 in connection with the capacitors 106 and 116 and the resistors 105 and 115 acting as analog computers conduct the output therefrom feeding the same to analog selector devices 931 and 932. The selector 931 will output the computed negative analog voltages at 931*a* and the selector 932 will output the computed positive analog voltages at 932*a*. The output of the analog voltages is sequentially outputted by the action of binary counter 916 to be described. Since the output of said selectors is controlled by said counter, the output of said selectors will always be the negative and positive voltages of the same computed spark plug voltage or electrical signal output.

The outputs 931*a* and 932*a* of the selectors 931 and 932 are fed into differential amplifiers 941, 944 and 947, the output of which is the sum of the magnitude of the computed negative and positive weighted running average voltages calculated by the previously described analog computers.

A reason why the output from the differential amplifier is better than the output from either selector individually is that the polarity of the spark electrical signal is different for different engines and sometimes different within a given engine. Therefore, combining the polarities into one output removes the requirement that the device user know the polarity of the spark being analyzed and act accordingly.

Another reason is that problems with an engine's performance will generally have similar effects on the magnitude of both the positive and negative signals being analyzed. Hence, the effect of a bad engine performance is normally increased and may be doubled by combining the two outputs for a better analysis.

Said binary counter 925 is formed by the combination of an oscillator 915 driving a counter 916. The frequency of the oscillator is about 8 kilo hertz. Outputs 916*a*, 916*b* and 916*c*from said counter determine which two of the sixteen computed analog voltages (eight circuits) of the device 50 herein are selected by the selectors 931 and 932. When eight possible outputs have been cycled through by counter 916, an output trigger 917 from the counter provides a signal for an oscilloscope display through the outlet 948 of said amplifiers 941, 944 and 947. The resistors 942, 943, 945 and 946 determine the gain for said amplifiers. This trigger signal insures that the user will always see the computed output from the first spark plug wire at the far left of an oscilloscope screen and the other seven spark plug wires in their embodiment will be seen in order displayed from left to right on the screen. The reference numerals and/or characters within said counter and said selectors relate to specific cylinders of the engine and to the specific circuits 100–800 for sequential output on a display. The counter and selectors are conventional elements.

Figure 4:
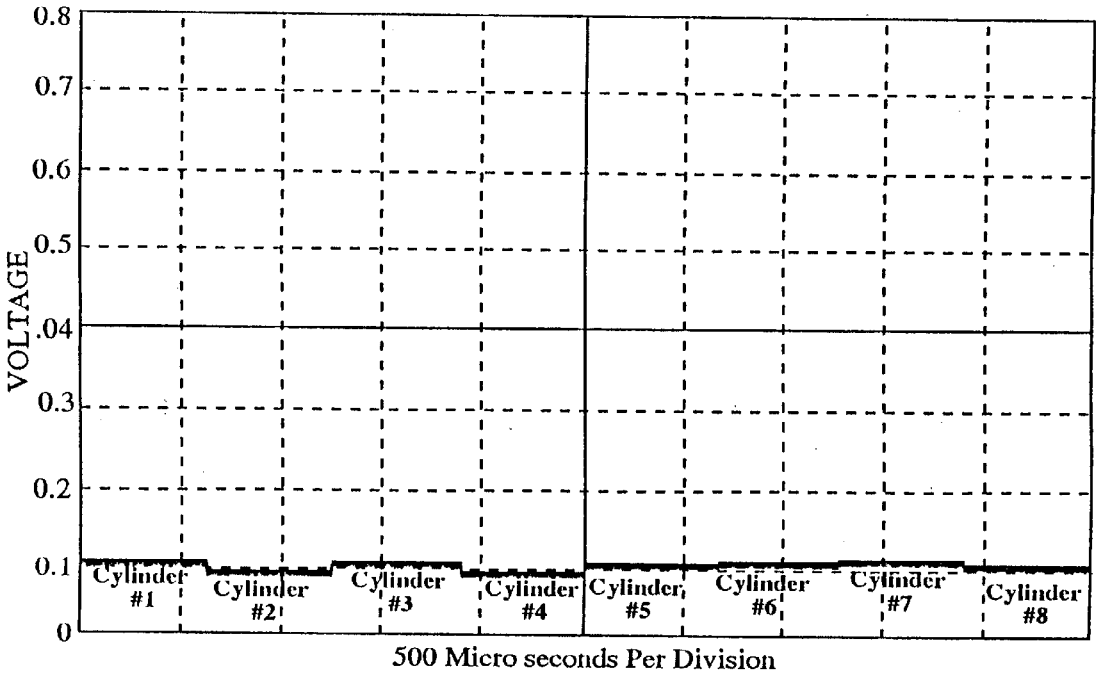
FIG. 4 is a diagrammatic view of an output display.
Figure 5:
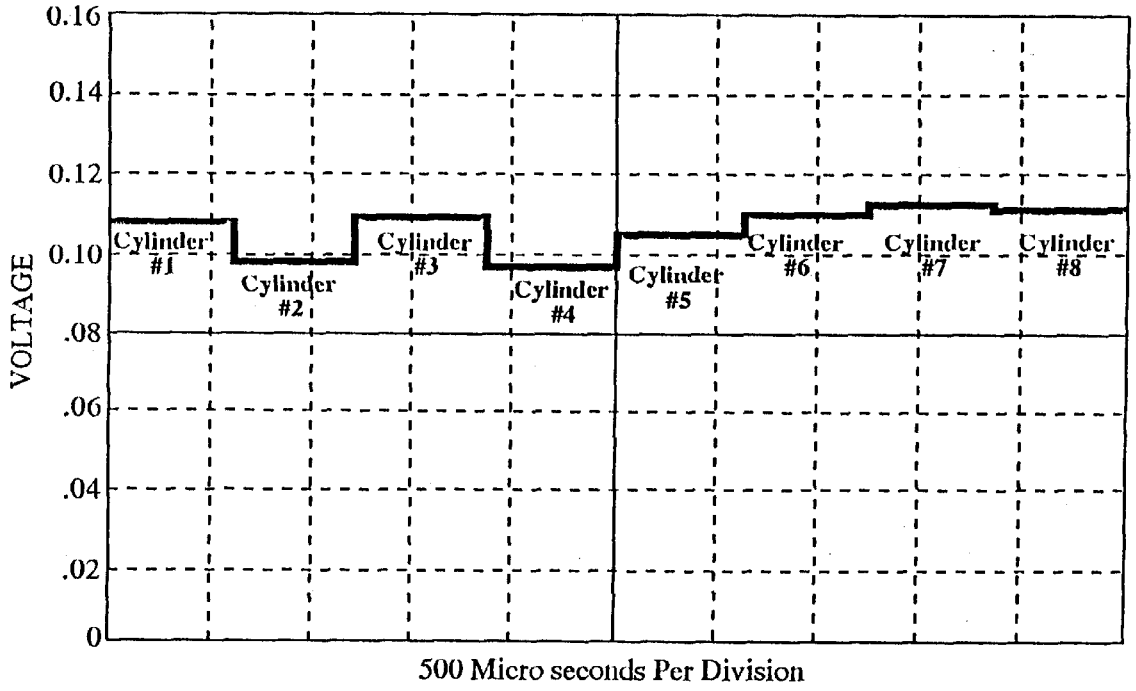
FIG. 5 is a view similar to that of FIG. 4.
Figure 6:
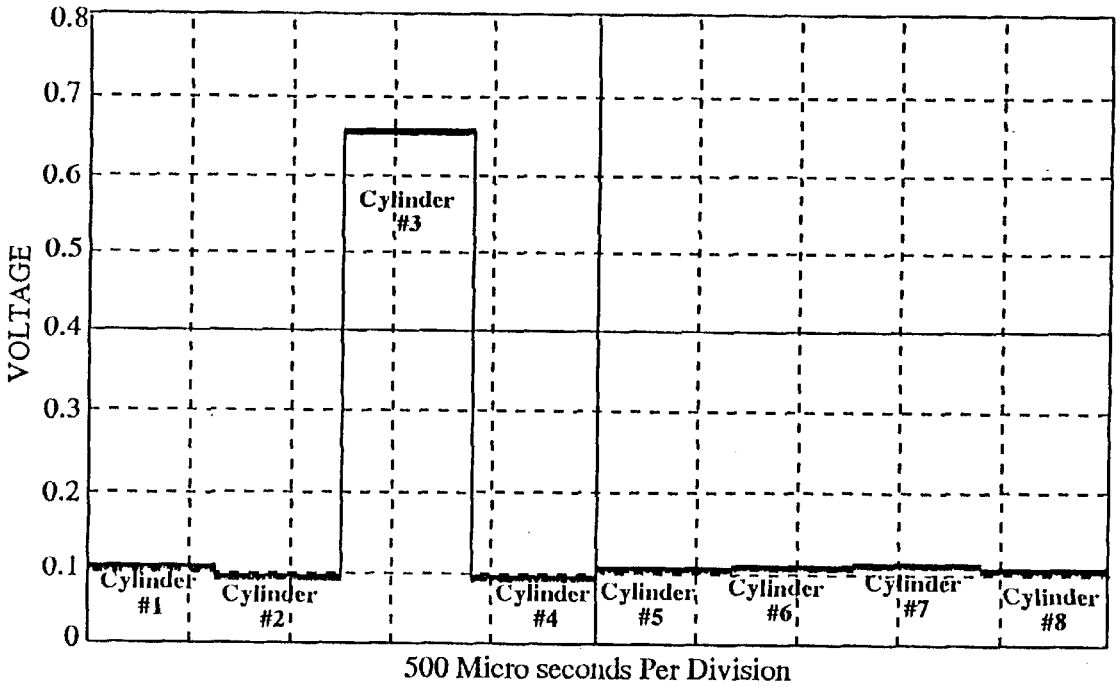
FIG. 6 is a view similar to that of FIG. 5 showing a problem condition.

The output of which examples are shown in FIG. 4–6 is designed to be displayed on any standard oscilloscope. When thus displayed, the user would see the sum of the magnitude of the negative and positive computed average peak voltages side by side on a screen in sequence through the circuits 100–800 and repeating in the same pattern. In connection with said counter 916, the diodes 921 and 922 flash to indicate the counter is operating. The capacitors 901 and 913 are by-passes and the resistors 911 and 912 determine the frequency of the output of said counter 925.

This device processes its output from its analog computation from the capacitors 106, 116 and resistors 105, 115 so that a technician can easily see the problems with an engine by looking at a display on an oscilloscope. It is noted here that the information from the analog computers could be transmitted to a digital computer for analysis of which there is an installation with many engines. In accordance with one aspect of the present invention, engine performance diagnosis, whether by a computer or a technician, involves comparing the output voltage corresponding to one individual spark plug with output voltages corresponding to the remainder of the other spark plugs over a variety of engine operating conditions.

A further description is given of the output voltage which comprises the breakdown voltage, collapsing field voltage and spark voltage pulse duration. The breakdown voltage reaches its greatest magnitude just before the current begins to flow in the spark plug and the collapsing field voltage is an oscillation that occurs right after the current has stopped flowing in the spark plug (see FIG. 7). The duration of the spark is the time that elapses from the peak of the breakdown voltage to the beginning of the collapsing field voltage.

With regard to ionized gases generated, a decrease in ionized gases results in an increase in breakdown voltage and a decrease in ionized gases results in an increase in collapsing field voltage. A decrease in ionized gases also usually results in a shorter and more intense spark plug spark.

In result, analyses of the element of breakdown voltages and spark duration provide information about previous engine cycles while an analysis of the element of collapsing field voltage provides information about current engine cycles. A valid conclusion may be made that an analysis based on collapsing field voltage in combination with breakdown voltage and/or spark duration is more informative than an analysis based on only one of those elements.

The device described herein as the invention in its preferred embodiment can base its analysis of the breakdown voltage or collapsing field voltage depending on the speed specification of the operational amplifiers in its output circuitry. The outputs can be combined in either an additive or subtractive manner. If the output is subtractive, then the effect of residual ionized gases would affect the output.

FIG. 6 indicates a problem found by comparing cylinder 3 with the others. Cylinder 3 is regarded as having a problem because its voltage is so different than that of the other cylinders. If the problem is unrelated to an operating condition, it may relate to a defective spark plug or spark plug wire or it may indicate failure of an engine to burn fuel properly under those particular conditions that exist when a different voltage is displayed. In contrast, FIGS. 4 and 5 show a fairly uniform cylinder display of a properly running engine, FIG. 5 showing a magnified voltage scale relative to FIG. 4.

Problems can be seen by regarding a cylinder as of itself as improperly operating cylinders will often have an erratic element in their operation which will cause voltages to vary more than voltages of properly operating cylinders. By setting the oscilloscope sensitivity as high as possible and looking at the bounce of each cylinder's voltage, problems in a particular cylinder may be seen as in the case of the cylinder 3 in FIG. 6.

The correct voltages for a particular engine varying under a variety of operating conditions could be determined. Once the acceptable range of voltages has been determined, those outside of this range would indicate a problem with the engine. These readings could be used so that preventative maintenance may be performed before noticeable problems appear.

A power supply circuit 949 is an integral part of the circuitry 50 and the connection therewith although not here directly shown, is conventional and well known in the art.

The elements 950 and 953 of the circuitry 949 provide terminals for a battery connection to power said circuitry.

A resistor 961 limits current so that a sudden burst of current when the device is operating will not damage any component. A diode 962 prevents a reverse connected battery from damaging components. Resistors 963 and 964 create a reference voltage V3. Capacitors 965 and 966 stabilize the reference voltage V3 and the element 952 provides a ground for said voltage. With the reference voltage established, deviations therefrom can be noted to provide preventative maintenance before a noticeable problem appears.

The contacts of the reference voltage V3 are clearly shown throughout the circuitry 50. The power supply V2 is adapted for the digital circuitry as shown in connection with the counter 916 and the terminal V1 provides a general power supply.

It will, of course, be understood that various changes may be made in the form, details, arrangement and proportions of the parts without departing from the scope of the invention herein, which, generally stated, consists in a device capable of carrying out the object above set forth, in the parts and combination of parts disclosed and defined in the appended claims.

What is claimed is:

1. An apparatus for indicating internal combustion engine performance, where said engine includes a plurality of combustion cylinders each having at least one spark plug associated therewith, where each spark plug includes a pair of electrodes defining a spark plug gap, and means for cyclically coupling an electric potential source to said pair of spark plug electrodes so as to generate a spark plug voltage for each spark plug associated with each combustion cylinder in accordance with a predetermined timing sequence for each engine cycle, and where said spark plug voltage for each spark cycle is characterized by a breakover voltage occurring during an initial breakover time interval, followed by a spark duration voltage occurring during a spark duration time interval, and ending with a collapsing field voltage occurring during a collapsing field voltage time interval, said apparatus comprising:

a plurality of gap voltage detecting means, where each one of said plurality of gap voltage detecting means is associated with a respective one of said plurality of spark plugs, and wherein each of said gap voltage detecting means provides a continuous gap signal voltage representative of the voltage across said pair of electrodes of said spark plug associated therewith; and a plurality of signal processing means, where each one of said plurality of signal processing means is electrically coupled to a respective one of said plurality of gap voltage detecting means (i) for receiving, as an input, said gap signal voltage associated with said respective one of said gap signal voltage detecting means, and (ii) deriving from peak portions of said gap signal voltage, a performance output signal representative of a selected function of said input gap signal voltage associated with a corresponding one of said plurality of spark plugs, and which said performance output signal represents an accumulative function of said gap signal voltage over a plurality of engine cycles so as to indicate a combustion condition of a corresponding one of said plurality of combustion cylinders of said engine.

2. The apparatus of claim 1 furthers including display means for concurrently displaying said performance output signal associated with each of said plurality of signal processing means.

3. The apparatus of claim 1 wherein each of said signal processing means includes:

a first operational amplifier means, having a selected response time, and including an input signal terminating means for receiving said gap signal voltage, and an output terminating mean for providing an amplifier output signal;

a first diode rectifier means having an anode and a cathode; and a first resistance means;

a first capacitance means having, a first terminating means electrically coupled to (i) a selected one of said anode and cathode of said first diode rectifier means with the remaining one of said anode and cathode electrically coupled to said output means of said first operational amplifier, and (ii) a first terminating means of said first resistance means, and a second terminating means electrically coupled to a second terminating means of said first resistance means.

4. The apparatus of claim 3 wherein each of said signal processing means further includes:

a second operational amplifier means, having a selected response time, and including an input signal terminating means for receiving said input gap signal voltage, and an output terminating mean for providing an amplifier output signal;

a second diode rectifier means having an anode and a cathode;

a second resistance means; and a second capacitance means having, a first terminating means electrically coupled to (i) a selected one of said anode and cathode of said second diode rectifier means with the remaining one thereof electrically coupled to said output means of said second operational amplifier such that current is permitted to flow through said second diode rectifier means in an opposite direction relative to said first diode rectifier means in response to an input gap signal voltage, and (ii) a first terminating means of said second resistance means, and a second terminating means electrically coupled to a second terminating means of said second resistance means;

means for summing the voltage stored on said first and second capacitance means and providing a sum signal indicative thereof.

5. The apparatus of claim 1 wherein each of said signal processing means includes, first means for operating on said gap signal voltage for passing peak portions of said gap signal voltage therethrough; and function means responsive to said peak portions of said gap signal voltage for providing a performance output signal representative of a selected accumulative function of said peak portions over a plurality of engine cycles.

6. The apparatus of claim 5 wherein said selected accumulative function is an average-like function of said peak portions of said gap signal voltage averaged over said plurality of engine cycles.

7. The apparatus of claim 5 wherein said selected accumulative function is an integrating-like function of said peak portions integrated over said plurality of engine cycles.

8. The apparatus of claim 5 wherein:

said first means for operating on said gap signal voltage includes, a first circuit means for passing only positive peak portions of said gap signal voltage therethrough, and a second circuit means for passing only negative peak portions of said gap signal voltage therethrough; and said function means includes, first means responsive to said positive peak portions of said gap signal voltage for providing a first intermediate performance output signal representative of a selected accumulative function of said positive peak value portions, and second means responsive to said negative peak portions of said gap signal voltage for providing a second intermediate performance output signal representative of a selected accumulative function of said negative peak value portions.

9. The apparatus of claim 8 further including:

a summing means associated with each of said plurality of said signal processing means for summing said first and second intermediate performance output signals associated therewith, thereby providing said performance output signal;

selector means having a plurality of input means and an output means, one of each of said plurality of input means being coupled to one of said signal processing means for receiving said performance output signal therefrom, said selector means operative for sequentially outputting said performance output signal from each of said plurality of signal processing means on to said single selector output means; and display means coupled to said output means of said selector means for concurrently displaying said performance output signal associated with each of said plurality of signal processing means.

10. The apparatus of claim 8 further including a selector means operative for sequentially connecting each pair of said first and second intermediate signals of each of said plurality of signal processing means to respective ones of first and second input means of a summing means for summing said first and second intermediate signals so as to provide said performance output signal indicative of a combustion condition of a corresponding one of said plurality of combustion cylinders of said engine.

11. The apparatus of claim 8 further including:

first selector means having a plurality of input means and a selector output means for receiving said first intermediate performance signal from each of said signal processing means, said first selector means operative for sequentially outputting said first intermediate performance output signal from each of said plurality of signal processing means on to said single selector output means of said first selector output means;

second selector means having a plurality of input means and a selector output means for receiving said second intermediate performance signal from each of said signal processing means, said second selector means operative for sequentially outputting said second intermediate performance output signal from each of said plurality of signal processing means on to said single selector output means of said second selector means; and summing means having first and second input means coupled to said first and second selector means single selector out put means, respectively, for sequentially summing said first and second intermediate signals associated with each of said signal processing means so as to provide said performance output signal indicative of a combustion condition of a corresponding one of said plurality of combustion cylinders of said engine.

12. The apparatus of claim 1 wherein said selected function of said input gap signal voltage is such so as to derive, therefrom, a performance output signal representative of an accumulative function of said collapsing field voltage for each cycle of said gap signal voltage over a plurality of engine cycles.

13. The apparatus of claim 1 wherein said peak portions of said gap signal voltage selectively includes positive and negative peak portions of said gap signal voltage.

14. The apparatus of claim 1 wherein said peak portions of said gap signal voltage includes both positive and negative peak portions of said gap signal voltage.

15. A method for indicating internal combustion engine performance, where said engine includes a plurality of combustion cylinders each having at least one spark plug associated therewith, where each spark plug includes a pair of electrodes defining a spark plug gap, and means for cyclically coupling an electric potential source to said pair of spark plug electrodes so as to generate a spark plug voltage for each spark plug associated with each combustion cylinder in accordance with a predetermined timing sequence for each engine cycle, and where said spark plug voltage for each spark cycle is characterized by a breakover voltage occurring during an initial breakover time interval, followed by a spark duration voltage occurring during a spark duration time interval, and ending with a collapsing field voltage occurring during a collapsing field voltage time interval, the method comprising the steps of:

detecting the spark plug gap voltage for each one of said plurality of spark plugs and providing a continuous gap signal voltage representative of the voltage across said pair of electrodes of said spark plug for each of said plurality of spark plugs; and separately signal processing said gap signal voltage associated with each one of said plurality of spark plugs and separately deriving from peak portions of said gap signal voltage, a performance output signal representative of a selected function of said input gap signal voltage associated with a corresponding one of said plurality of spark plugs, and which said performance output signal represents an accumulative function of said gap signal voltage over a plurality of engine cycles so as to indicate a combustion condition of a corresponding one of said plurality of combustion cylinders of said engine.

16. The method of claim 15 wherein said selected function is specifically responsive to peak portions of said gap signal voltage corresponding to peak portions of said collapsing field voltage during said collapsing field voltage time interval, and said method includes the step of determining a running average-like value of representative of the average of peak values of said gap signal voltage for a number of engine cycles.

17. The method of claim 15 wherein said peak portions of said gap signal voltage selectively includes positive and negative peak portions of said gap signal voltage.

18. The method of claim 15 wherein said peak portions of said gap signal voltage includes both positive and negative peak portions of said gap signal voltage.

19. An apparatus for indicating internal combustion engine performance, where said engine includes a plurality of combustion cylinders each having at least one spark plug associated therewith, where each spark plug includes a pair of electrodes defining a spark plug gap, and means for cyclically coupling an electric potential source to said pair of spark plug electrodes so as to generate a spark plug voltage for each spark plug associated with each combustion cylinder in accordance with a predetermined timing sequence for each engine cycle, and where said spark plug voltage for each spark cycle is characterized by a breakover voltage occurring during an initial breakover time interval, followed by a spark duration voltage occurring during a spark duration time interval, and ending with a collapsing field voltage occurring during a collapsing field voltage time interval, said apparatus comprising:

a plurality of gap voltage detecting means, where each one of said plurality of gap voltage detecting means is associated with a respective one of said plurality of spark plugs, and wherein each of said gap voltage detecting means provides a continuous gap signal voltage representative of the voltage across said pair of electrodes of said spark plug associated therewith;

a plurality of signal processing means, where each one of said plurality of signal processing means is electrically coupled to a respective one of said plurality of gap voltage detecting means and each signal processing means includes, first circuit means responsive to said gap signal voltage for providing a first intermediate signal representative of an average of peak positive values of said gap signal voltage occurring over a number of engine cycles, second circuit means responsive to said gap signal voltage for providing a second intermediate signal representative of an average of peak negative values of said gap signal voltage occurring over a number of engine cycles, and third circuit means for summing for providing a performance output signal as a function of the sum of said first and second intermediate signals, where said performance output signal is indicative of a combustion condition of a corresponding one of said plurality of combustion cylinders of said engine; and means for concurrently displaying said performance output signal associated with each of said signal processing means so as to be able to compare the combustion condition of each of said cylinders relative to each other.

* * * * *